US009008558B2

(12) United States Patent
Saito et al.

(10) Patent No.: US 9,008,558 B2
(45) Date of Patent: Apr. 14, 2015

(54) SEPARATOR AND SEPARATION DEVICE, FIXING DEVICE, AND IMAGE FORMING APPARATUS INCORPORATING SAME

(71) Applicants: Kazuya Saito, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Hiromasa Takagi, Tokyo (JP); Takahiro Imada, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP); Hiroshi Yoshinaga, Chiba (JP)

(72) Inventors: Kazuya Saito, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Hiromasa Takagi, Tokyo (JP); Takahiro Imada, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 75 days.

(21) Appl. No.: 13/721,936

(22) Filed: Dec. 20, 2012

(65) Prior Publication Data

US 2013/0189005 A1 Jul. 25, 2013

(30) Foreign Application Priority Data

Jan. 19, 2012 (JP) ..... 2012-009339

(51) Int. Cl.
*G03G 15/20* (2006.01)

(52) U.S. Cl.
CPC ..... *G03G 15/2085* (2013.01); *G03G 15/2053* (2013.01); *G03G 2215/2035* (2013.01)

(58) Field of Classification Search
CPC ..... G03G 15/20
USPC ..... 399/323
See application file for complete search history.

(56) References Cited

U.S. PATENT DOCUMENTS 7,466,949 B2 * 12/2008 Satoh et al. ..... 399/323

(Continued)

FOREIGN PATENT DOCUMENTS

| | | |
|---|---|---|
| JP | 2007-233011 | 9/2007 |
| JP | 2007-334205 | 12/2007 |
| JP | 2011-180220 | 9/2011 |

OTHER PUBLICATIONS

U.S. Appl. No. 13/557,841, filed Jul. 25, 2012, Toshihiko Shimokawa, et al.

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

A separator includes a front edge disposed opposite an outer circumferential surface of an endless belt. The front edge contacts and separates a recording medium from the endless belt. A separation plate mounts the front edge. A contact plate projects from the separation plate in an axial direction of the endless belt and contacts a belt holder that supports the endless belt. A bracket projects from the separation plate in a direction orthogonal to the direction in which the contact plate projects from the separation plate. The bracket includes a notch that engages the belt holder. The contact plate contacting the belt holder and the notch of the bracket engaging the belt holder produce an interval between the front edge of the separator and the outer circumferential surface of the endless belt.

20 Claims, 6 Drawing Sheets

(56) References Cited

U.S. PATENT DOCUMENTS

| | | | | |
|---|---|---|---|---|
| 7,751,768 | B2 * | 7/2010 | Yamada | 399/323 |
| 7,962,079 | B2 * | 6/2011 | Ogata | 399/323 |
| 8,320,808 | B2 * | 11/2012 | Yamada | 399/323 |
| 2004/0146323 | A1 * | 7/2004 | Fujisawa et al. | 399/323 |
| 2005/0008408 | A1 * | 1/2005 | Inomata | 399/323 |
| 2006/0029411 | A1 | 2/2006 | Ishii et al. | |
| 2007/0048035 | A1 * | 3/2007 | Baba et al. | 399/323 |
| 2007/0189818 | A1 * | 8/2007 | Kondo et al. | 399/329 |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2007/0292175 | A1 * | 12/2007 | Shinshi | 399/329 |
| 2008/0025772 | A1 | 1/2008 | Seo et al. | |
| 2008/0025773 | A1 | 1/2008 | Ito et al. | |
| 2008/0080909 | A1 * | 4/2008 | Yamada | 399/323 |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2009/0123201 | A1 | 5/2009 | Ehara et al. | |
| 2009/0148205 | A1 | 6/2009 | Seo et al. | |
| 2009/0245865 | A1 * | 10/2009 | Shinshi et al. | 399/122 |
| 2009/0245897 | A1 | 10/2009 | Seo et al. | |
| 2009/0297197 | A1 * | 12/2009 | Hase | 399/69 |
| 2010/0046994 | A1 * | 2/2010 | Kikuchi et al. | 399/320 |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 * | 11/2010 | Hasegawa et al. | 399/329 |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 * | 2/2011 | Shimokawa et al. | 399/322 |
| 2011/0052237 | A1 * | 3/2011 | Yoshikawa et al. | 399/69 |
| 2011/0052245 | A1 | 3/2011 | Shinshi et al. | |
| 2011/0052277 | A1 | 3/2011 | Ueno et al. | |
| 2011/0052282 | A1 * | 3/2011 | Shinshi et al. | 399/329 |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182631 | A1 * | 7/2011 | Soeda | 399/323 |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 * | 9/2011 | Iwaya et al. | 399/323 |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0217096 | A1 * | 9/2011 | Kikuchi et al. | 399/329 |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2012/0243919 | A1 * | 9/2012 | Takagi et al. | 399/323 |
| 2013/0189005 | A1 * | 7/2013 | Saito et al. | 399/323 |
| 2013/0236225 | A1 * | 9/2013 | Ogawa et al. | 399/329 |

* cited by examiner

SEPARATOR AND SEPARATION DEVICE, FIXING DEVICE, AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-009339, filed on Jan. 19, 2012, in the Japanese Patent Office, the entire disclosure of which is hereby incorporated by reference herein.

BACKGROUND OF THE INVENTION

1. Field of the Invention

Example embodiments generally relate to a separator, a separation device, a fixing device, and an image forming apparatus, and more particularly, to a separator for separating a recording medium from an endless belt, a separation device incorporating the separator, a fixing device for fixing a toner image on a recording medium and incorporating the separation device, and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time required to output the recording medium bearing the toner image onto the outside of the image forming apparatus after the image forming apparatus receives a print job. Additionally, the fixing device is requested to generate an increased amount of heat before a plurality of recording media is conveyed through the fixing device continuously at an increased speed.

To address these requests, the fixing device may employ a thin endless belt having a decreased thermal capacity and therefore heated quickly by a heater. FIG. 1 illustrates a fixing device 20R1 incorporating an endless belt 100 heated by a heater 300. As shown in FIG. 1, a pressing roller 400 is pressed against a tubular metal thermal conductor 200 disposed inside a loop formed by the endless belt 100 to form a fixing nip N between the pressing roller 400 and the endless belt 100. The heater 300 disposed inside the metal thermal conductor 200 heats the entire endless belt 100 via the metal thermal conductor 200. As the pressing roller 400 rotating clockwise and the endless belt 100 rotating counterclockwise in FIG. 1 convey a recording medium P bearing a toner image T through the fixing nip N in a recording medium conveyance direction A1, the endless belt 100 and the pressing roller 400 apply heat and pressure to the recording medium P, thus fixing the toner image T on the recording medium P.

Since the metal thermal conductor 200 heats the endless belt 100 entirely, the endless belt 100 is heated to a given fixing temperature quickly, thus meeting the above-described requests of shortening the first print time and generating the increased amount of heat for high speed printing. However, in order to shorten the first print time further and save more energy, the fixing device is requested to heat the endless belt more efficiently. To address this request, a configuration to heat the endless belt directly, not via the metal thermal conductor, is proposed as shown in FIG. 2.

FIG. 2 illustrates a fixing device 20R2 in which the heater 300 heats the endless belt 100 directly. Instead of the metal thermal conductor 200 depicted in FIG. 1, a nip formation plate 500 is disposed inside the loop formed by the endless belt 100 and presses against the pressing roller 400 via the endless belt 100 to form the fixing nip N between the endless belt 100 and the pressing roller 400. Since the nip formation plate 500 does not encircle the heater 300 unlike the metal thermal conductor 200 depicted in FIG. 1, the heater 300 heats the endless belt 100 directly, thus improving heating efficiency for heating the endless belt 100 and thereby shortening the first print time further and saving more energy.

On the other hand, the fixing devices 20R1 and 20R2 may include a separator situated downstream from the fixing nip N in the recording medium conveyance direction A1 to contact and separate the recording medium P discharged from the fixing nip N from the endless belt 100. For example, the separator includes legs that pressingly contact both lateral ends on the outer circumferential surface of the endless belt in the axial direction thereof to remove slack from the endless belt and at the same time position the separator with respect to the outer circumferential surface of the endless belt.

If the separator is installed in the fixing device 20R1 shown in FIG. 1, the rigid, tubular metal thermal conductor 200 supporting the endless belt 100 throughout the entire width in the axial direction thereof prevents the flexible endless belt 100 from being deformed by pressure from the legs of the separator. Conversely, if the separator is installed in the fixing device 20R2 shown in FIG. 2, the nip formation plate 500 supporting the endless belt 100 only at the fixing nip N cannot support the endless belt 100 against pressure from the separator at the position downstream from the fixing nip N in the recording medium conveyance direction A1. Accordingly, the endless belt 100 may be deformed by pressure from the separator. Consequently, the separator with the legs contacting the deformed endless belt 100 may be positioned with respect to the outer circumferential surface of the endless belt 100 improperly. For example, an uneven interval may be produced between the separator and the outer circumferential surface of the endless belt 100 throughout the entire width in the axial direction thereof, resulting in faulty separation of the recording medium P from the endless belt 100. Further, the separator may strike the endless belt 100, resulting in abrasion or breakage of the endless belt 100.

SUMMARY OF THE INVENTION

At least one embodiment may provide a separator for separating a recording medium from an outer circumferential surface of an endless belt supported by a belt holder contacting each lateral end of the endless belt in an axial direction thereof. The separator includes a front edge disposed opposite the outer circumferential surface of the endless belt, the front edge to contact and separate the recording medium from the endless belt; a separation plate mounting the front edge; a contact plate projecting from the separation plate in the axial direction of the endless belt and contacting the belt holder; and a bracket projecting from the separation plate in a direction orthogonal to the direction in which the contact plate projects from the separation plate. The bracket includes a notch that engages the belt holder. The contact plate contacting the belt holder and the notch of the bracket engaging the belt holder produce an interval between the front edge of the separator and the outer circumferential surface of the endless belt.

At least one embodiment may provide a separation device that includes an endless belt rotatable in a given direction of rotation, a belt holder contacting and supporting each lateral end of the endless belt in an axial direction thereof, and a separator disposed opposite an outer circumferential surface of the endless belt. The separator includes a front edge to contact and separate the recording medium from the endless belt. The separator is contacted and positioned by the belt holder with respect to the outer circumferential surface of the endless belt with an interval between the front edge of the separator and the outer circumferential surface of the endless belt.

At least one embodiment may provide a fixing device that includes an endless belt rotatable in a given direction of rotation; a belt holder contacting and supporting each lateral end of the endless belt in an axial direction thereof; a nip formation assembly disposed opposite an inner circumferential surface of the endless belt; an opposed rotary body pressed against the nip formation assembly via the endless belt to form a fixing nip between the opposed rotary body and the endless belt through which a recording medium is conveyed; and a separator disposed opposite an outer circumferential surface of the endless belt. The separator includes a front edge to contact and separate the recording medium from the endless belt. The separator is contacted and positioned by the belt holder with respect to the outer circumferential surface of the endless belt with an interval between the front edge of the separator and the outer circumferential surface of the endless belt.

At least one embodiment may provide an image forming apparatus including the fixing device described above.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
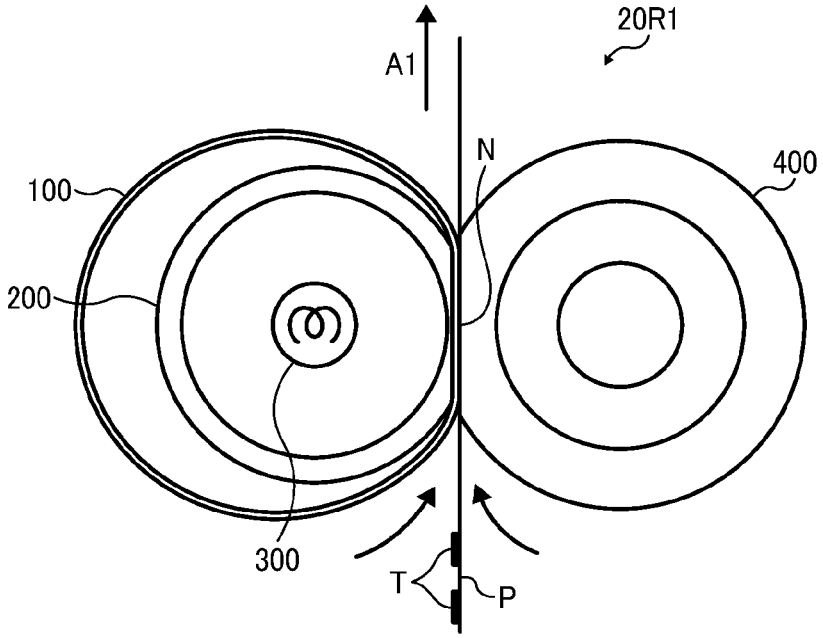
FIG. 1 RELATED ART
FIG. 1 is a vertical sectional view of a first related-art fixing device.
Figure 2:
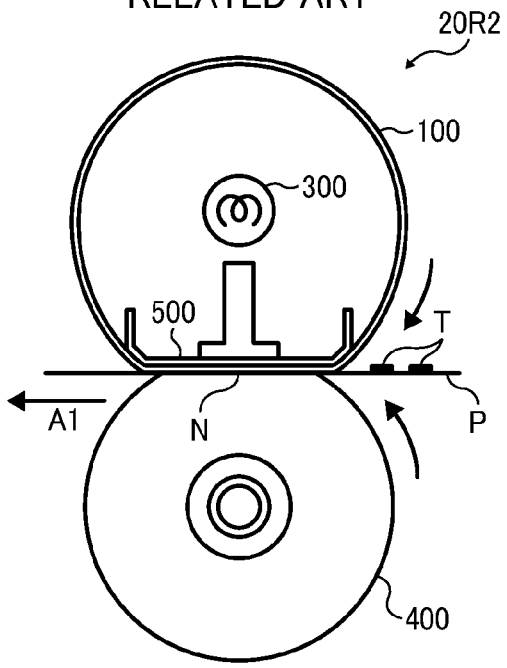
FIG. 2 RELATED ART
FIG. 2 is a vertical sectional view of a second related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
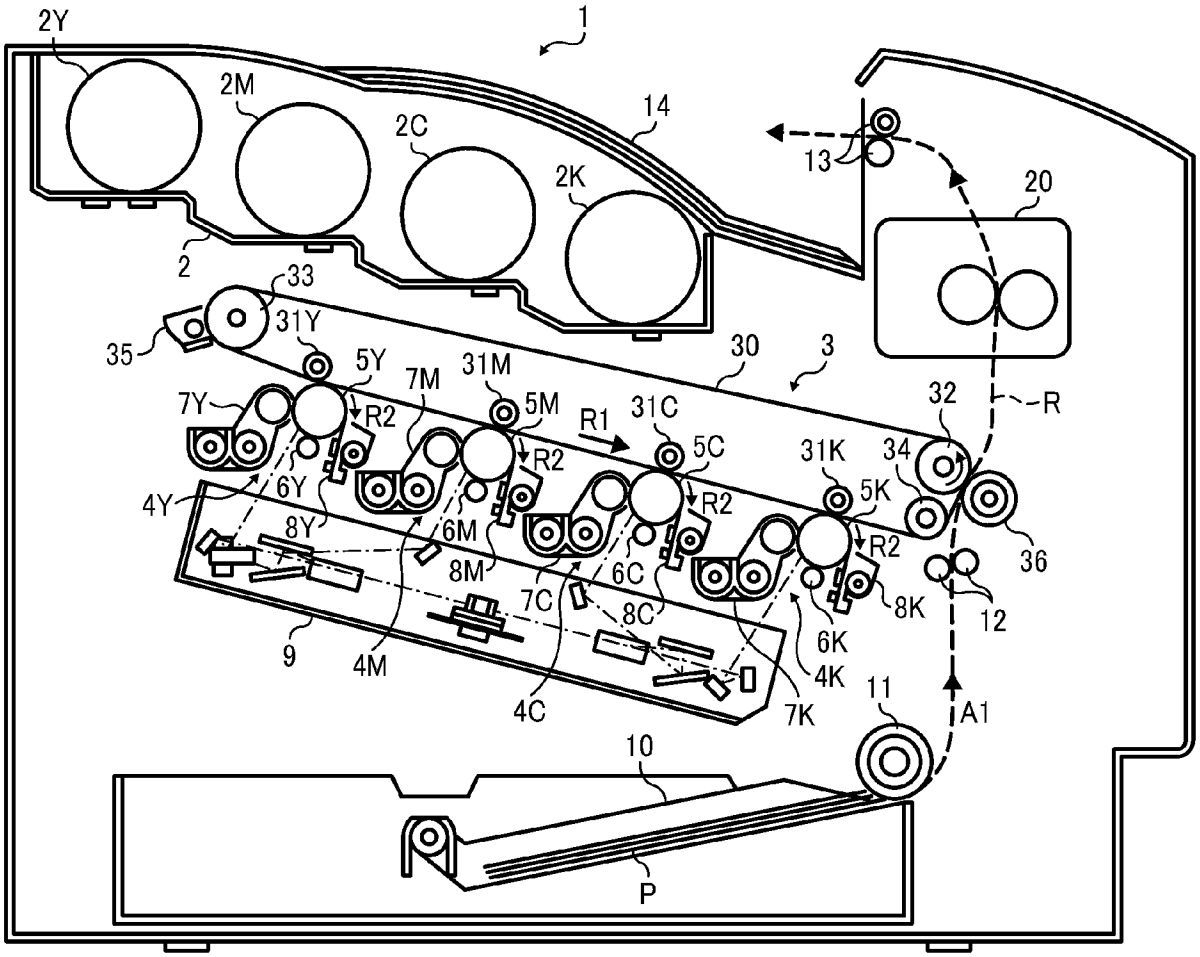
FIG. 3 is a schematic vertical sectional view of an image forming apparatus according to an example embodiment of the present invention.

Referring now to the drawings, wherein like reference numerals designate identical or corresponding parts throughout the several views, particularly to FIG. 3, an image forming apparatus 1 according to an example embodiment is explained.

FIG. 3 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this example embodiment, the image forming apparatus 1 is a color laser printer that forms a toner image on a recording medium P by electrophotography.

As shown in FIG. 3, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, the image forming devices 4Y, 4M, 4C, and 4K include drum-shaped photoconductors 5Y, 5M, 5C, and 5K serving as an image carrier that carries an electrostatic latent image and a resultant toner image; chargers 6Y, 6M, 6C, and 6K that charge an outer circumferential surface of the respective photoconductors 5Y, 5M, 5C, and 5K; development devices 7Y, 7M, 7C, and 7K that supply yellow, magenta, cyan, and black toners to the electrostatic latent images formed on the outer circumferential surface of the respective photoconductors 5Y, 5M, 5C, and 5K, thus visualizing the electrostatic latent images into yellow, magenta, cyan, and black toner images with the yellow, magenta, cyan, and black toners, respectively; and cleaners 8Y, 8M, 8C, and 8K that clean the outer circumferential surface of the respective photoconductors 5Y, 5M, 5C, and 5K.

Below the image forming devices 4Y, 4M, 4C, and 4K is an exposure device 9 that exposes the outer circumferential surface of the respective photoconductors 5Y, 5M, 5C, and 5K with laser beams. For example, the exposure device 9, constructed of a light source, a polygon mirror, an f-θ lens, reflection minors, and the like, emits a laser beam onto the outer circumferential surface of the respective photoconductors 5Y, 5M, 5C, and 5K according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31Y, 31M, 31C, and 31K serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched over the secondary transfer backup roller 32, the cleaning backup roller 33, and the tension roller 34. As a driver drives and rotates the secondary transfer backup roller 32 counterclockwise in FIG. 3, the secondary transfer backup roller 32 rotates the intermediate transfer belt 30 in a rotation direction R1 by friction therebetween.

The four primary transfer rollers 31Y, 31M, 31C, and 31K sandwich the intermediate transfer belt 30 together with the four photoconductors 5Y, 5M, 5C, and 5K, respectively, forming four primary transfer nips between the intermediate transfer belt 30 and the photoconductors 5Y, 5M, 5C, and 5K. The primary transfer rollers 31Y, 31M, 31C, and 31K are connected to a power supply that applies a given direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31Y, 31M, 31C, and 31K, the secondary transfer roller 36 is connected to the power supply that applies a given direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle container 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7Y, 7M, 7C, and 7K of the image forming devices 4Y, 4M, 4C, and 4K, respectively. For example, the fresh yellow, magenta, cyan, and black toners are supplied from the toner bottles 2Y, 2M, 2C, and 2K to the development devices 7Y, 7M, 7C, and 7K through toner supply tubes interposed between the toner bottles 2Y, 2M, 2C, and 2K and the development devices 7Y, 7M, 7C, and 7K, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, tracing paper, OHP (overhead projector) transparencies, OHP film sheets, and the like. Additionally, a bypass tray may be attached to the image forming apparatus 1 that loads postcards, envelopes, OHP transparencies, OHP film sheets, and the like.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes the color toner image transferred from the intermediate transfer belt 30 onto the recording medium P. The conveyance path R is further provided with the output roller pair 13 located above the fixing device 20, that is, downstream from the fixing device 20 in the recording medium conveyance direction A1. The output roller pair 13 discharges the recording medium P bearing the fixed color toner image onto the outside of the image forming apparatus 1, that is, an output tray 14 disposed atop the image forming apparatus 1. The output tray 14 stocks the recording media P discharged by the output roller pair 13.

With reference to FIG. 3, a description is provided of an image forming operation of the image forming apparatus 1 having the structure described above to form a color toner image on a recording medium P.

As a print job starts, a driver drives and rotates the photoconductors 5Y, 5M, 5C, and 5K of the image forming devices 4Y, 4M, 4C, and 4K, respectively, clockwise in FIG. 3 in a rotation direction R2. The chargers 6Y, 6M, 6C, and 6K uniformly charge the outer circumferential surface of the respective photoconductors 5Y, 5M, 5C, and 5K at a given polarity. The exposure device 9 emits laser beams onto the charged outer circumferential surface of the respective photoconductors 5Y, 5M, 5C, and 5K according to yellow, magenta, cyan, and black image data contained in image data sent from the external device, respectively, thus forming electrostatic latent images thereon. The development devices 7Y, 7M, 7C, and 7K supply yellow, magenta, cyan, and black toners to the electrostatic latent images formed on the photoconductors 5Y, 5M, 5C, and 5K, visualizing the electrostatic latent images into yellow, magenta, cyan, and black toner images, respectively.

Simultaneously, as the print job starts, the secondary transfer backup roller 32 is driven and rotated counterclockwise in FIG. 3, rotating the intermediate transfer belt 30 in the rotation direction R1 by friction therebetween. A power supply applies a constant voltage or a constant current control voltage having a polarity opposite a polarity of the toner to the primary transfer rollers 31Y, 31M, 31C, and 31K. Thus, a transfer electric field is created at the primary transfer nips formed between the primary transfer rollers 31Y, 31M, 31C, and 31K and the photoconductors 5Y, 5M, 5C, and 5K, respectively.

When the yellow, magenta, cyan, and black toner images formed on the photoconductors 5Y, 5M, 5C, and 5K reach the primary transfer nips, respectively, in accordance with rotation of the photoconductors 5Y, 5M, 5C, and 5K, the yellow, magenta, cyan, and black toner images are primarily transferred from the photoconductors 5Y, 5M, 5C, and 5K onto the intermediate transfer belt 30 by the transfer electric field created at the primary transfer nips in such a manner that the yellow, magenta, cyan, and black toner images are superimposed successively on a same position on the intermediate transfer belt 30. Thus, a color toner image is formed on the intermediate transfer belt 30. After the primary transfer of the yellow, magenta, cyan, and black toner images from the photoconductors 5Y, 5M, 5C, and 5K onto the intermediate transfer belt 30, the cleaners 8Y, 8M, 8C, and 8K remove residual toner not transferred onto the intermediate transfer belt 30 and therefore remaining on the photoconductors 5Y, 5M, 5C, and 5K therefrom. Thereafter, dischargers discharge the outer circumferential surface of the respective photoconductors 5Y, 5M, 5C, and 5K, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. The registration roller pair 12 feeds the recording medium P to the secondary transfer nip formed between the secondary transfer roller 36 and the intermediate transfer belt 30 at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

When the color toner image formed on the intermediate transfer belt 30 reaches the secondary transfer nip in accordance with rotation of the intermediate transfer belt 30, the color toner image is secondarily transferred from the intermediate transfer belt 30 onto the recording medium P by the transfer electric field created at the secondary transfer nip. After the secondary transfer of the color toner image from the intermediate transfer belt 30 onto the recording medium P, the belt cleaner 35 removes residual toner not transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 4:
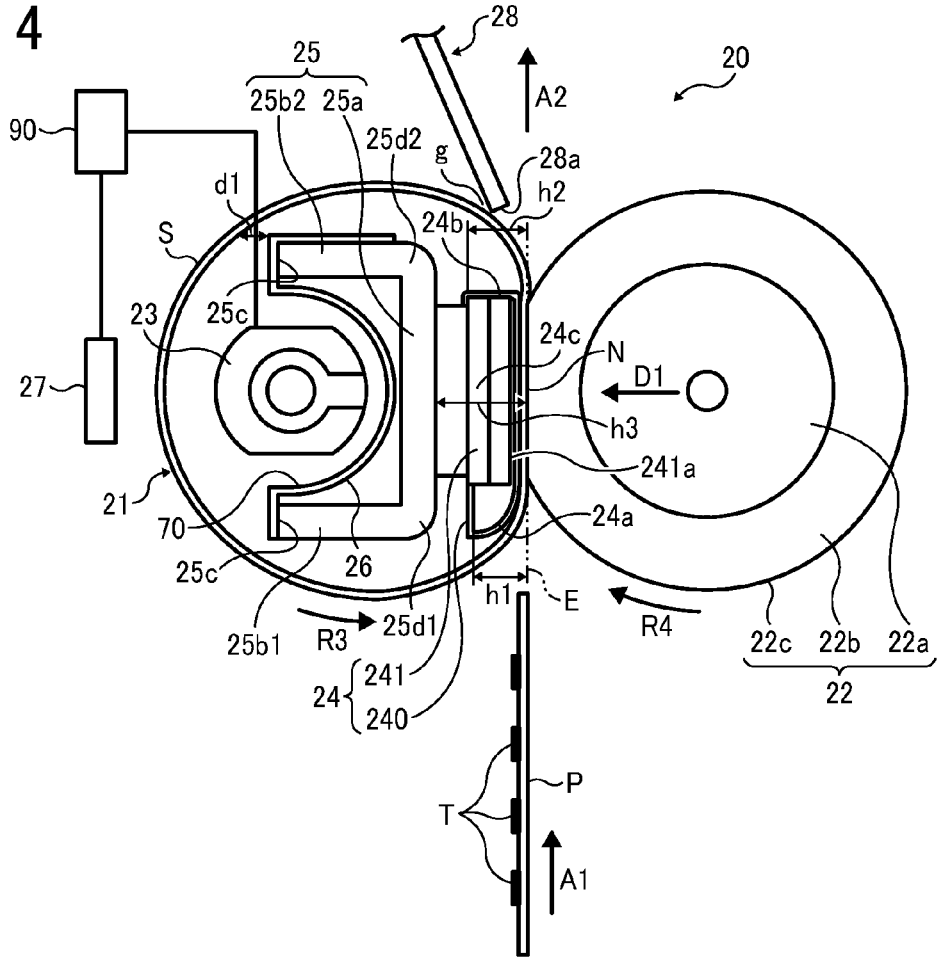
FIG. 4 is a vertical sectional view of a fixing device according to a first example embodiment of the present invention that is installed in the image forming apparatus shown in FIG. 3.

With reference to FIG. 4, a description is provided of a construction of the fixing device 20 according to a first example embodiment that is incorporated in the image forming apparatus 1 described above.

FIG. 4 is a vertical sectional view of the fixing device 20. As shown in FIG. 4, the fixing device 20 (e.g., a fuser) includes a fixing belt 21 serving as a fixing rotary body or an endless belt formed into a loop and rotatable in a rotation direction R3; a pressing roller 22 serving as an opposed rotary body disposed opposite an outer circumferential surface S of the fixing belt 21 and rotatable in a rotation direction R4 counter to the rotation direction R3 of the fixing belt 21; a halogen heater 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater 23 toward the fixing belt 21; a temperature sensor 27 serving as a temperature detector disposed opposite the outer circumferential surface S of the fixing belt 21 and detecting the temperature of the fixing belt 21; and a separator 28 disposed opposite the outer circumferential surface S of the fixing belt 21 and separating the recording medium P from the fixing belt 21. The fixing device 20 further includes a belt holder 40 described below that supports each lateral end of the fixing belt 21 in an axial direction thereof and a pressurization assembly that presses the pressing roller 22 against the nip formation assembly 24 via the fixing belt 21.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer, made of rubber such as silicone rubber, silicone rubber foam, and fluoro rubber, may be interposed between the base layer and the release layer.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a given length in the recording medium conveyance direction A1. A driver (e.g., a motor) disposed inside the image forming apparatus 1 depicted in FIG. 3 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this example embodiment, the pressing roller 22 is a solid roller. Alternatively, the pressing roller 22 may be a hollow roller. In this case, a heater such as a halogen heater may be disposed inside the hollow roller. If the pressing roller 22 does not incorporate the elastic layer 22*b*, the pressing roller 22 has a decreased thermal capacity that improves fixing performance of being heated to the given fixing temperature quickly. However, as the pressing roller 22 and the fixing belt 21 sandwich and press a toner image T on the recording medium P passing through the fixing nip N, slight surface asperities of the fixing belt 21 may be transferred onto the toner image T on the recording medium P, resulting in variation in gloss of the solid toner image T. To address this problem, it is preferable that the pressing roller 22 incorporates the elastic layer 22*b* having a thickness not smaller than about 100 micrometers. The elastic layer 22*b* having the thickness not smaller than about 100 micrometers elastically deforms to absorb slight surface asperities of the fixing belt 21, preventing variation in gloss of the toner image T on the recording medium P. The elastic layer 22*b* is made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21. According to this example embodiment, the pressing roller 22 is pressed against the fixing belt 21. Alternatively, the pressing roller 22 may merely contact the fixing belt 21 with no pressure therebetween.

A detailed description is now given of a configuration of the halogen heater 23.

Each lateral end of the halogen heater 23 in a longitudinal direction thereof parallel to the axial direction of the fixing belt 21 is mounted on the belt holder 40 described below. A power supply situated inside the image forming apparatus 1 supplies power to the halogen heater 23 so that the halogen heater 23 heats the fixing belt 21. A controller 90, that is, a central processing unit (CPU), provided with a random-access memory (RAM) and a read-only memory (ROM), for example, operatively connected to the halogen heater 23 and the temperature sensor 27 controls the halogen heater 23 based on the temperature of the fixing belt 21 detected by the temperature sensor 27 so as to adjust the temperature of the fixing belt 21 to a desired fixing temperature. Alternatively, an induction heater, a resistance heat generator, a carbon heater, or the like may be employed as a heater to heat the fixing belt 21 instead of the halogen heater 23.

A detailed description is now given of a construction of the nip formation assembly 24.

The nip formation assembly 24 includes a base pad 241 and a slide sheet 240 (e.g., a low-friction sheet) covering an outer surface of the base pad 241. A longitudinal direction of the base pad 241 is parallel to an axial direction of the fixing belt 21 or the pressing roller 22. The base pad 241 receives pressure from the pressing roller 22 to define the shape of the fixing nip N. The base pad 241 is mounted on and supported by the stay 25. Accordingly, even if the base pad 241 receives pressure from the pressing roller 22, the base pad 241 is not bent by the pressure and therefore produces a uniform nip width throughout the entire width of the pressing roller 22 in the axial direction thereof. The stay 25 is made of metal having an increased mechanical strength, such as stainless steel and iron, to prevent bending of the nip formation assembly 24. According to this example embodiment, an opposed face 241*a* of the base pad 241 disposed opposite the pressing roller 22 via the fixing belt 21 is planar to produce the linear fixing nip N that reduces pressure exerted to the base pad 241 by the pressing roller 22.

The base pad 241 is made of a rigid, heat-resistant material having an increased mechanical strength and a heat resistance against temperatures not lower than about 200 degrees centigrade. Accordingly, even if the base pad 241 is heated to a given fixing temperature range, the base pad 241 is not thermally deformed, thus retaining the desired shape of the fixing nip N stably and thereby maintaining the quality of the fixed toner image T on the recording medium P. For example, the base pad 241 is made of general heat-resistant resin such as polyether sulfone (PES), polyphenylene sulfide (PPS), liquid crystal polymer (LCP), polyether nitrile (PEN), polyamide imide (PAI), and polyether ether ketone (PEEK), metal, ceramic, or the like.

The slide sheet 240 is interposed at least between the base pad 241 and the fixing belt 21. For example, the slide sheet 240 covers at least the opposed face 241*a* of the base pad 241 disposed opposite the fixing belt 21 at the fixing nip N. That is, the base pad 241 contacts the fixing belt 21 indirectly via the slide sheet 240. As the fixing belt 21 rotates in the rotation direction R3, it slides over the slide sheet 240 with decreased friction therebetween, decreasing a driving torque exerted on the fixing belt 21. Alternatively, the nip formation assembly 24 may not incorporate the slide sheet 240.

A detailed description is now given of a construction of the reflector 26.

The reflector 26 is interposed between the stay 25 and the halogen heater 23. According to this example embodiment, the reflector 26 is mounted on the stay 25. For example, the reflector 26 is made of aluminum, stainless steel, or the like. The reflector 26 has a reflection face 70 that reflects light radiated from the halogen heater 23 thereto toward the fixing belt 21. Accordingly, the fixing belt 21 receives an increased amount of light from the halogen heater 23 and thereby is heated efficiently. Additionally, the reflector 26 minimizes transmission of radiation heat from the halogen heater 23 to the stay 25, thus saving energy.

A shield is interposed between the halogen heater 23 and the fixing belt 21 at both lateral ends of the fixing belt 21 in the axial direction thereof. The shield shields the fixing belt 21 against heat from the halogen heater 23. For example, even if a plurality of small recording media P is conveyed through the fixing nip N continuously, the shield prevents heat from the halogen heater 23 from being conducted to both lateral ends of the fixing belt 21 in the axial direction thereof where the small recording media P are not conveyed. Accordingly, both lateral ends of the fixing belt 21 do not overheat even in the absence of large recording media P that draw heat therefrom. Consequently, the shield minimizes thermal wear and damage of the fixing belt 21.

The fixing device 20 according to this example embodiment attains various improvements to save more energy and shorten a first print time required to output a recording medium P bearing a fixed toner image T onto the outside of the image forming apparatus 1 depicted in FIG. 3 after the image forming apparatus 1 receives a print job.

As a first improvement, the fixing device 20 employs a direct heating method in which the halogen heater 23 directly heats the fixing belt 21 at a portion thereof other than a nip portion thereof facing the fixing nip N. For example, as shown in FIG. 4, no component is interposed between the halogen heater 23 and the fixing belt 21 at an outward portion of the fixing belt 21 disposed opposite the temperature sensor 27. Accordingly, radiation heat from the halogen heater 23 is directly transmitted to the fixing belt 21 at the outward portion thereof.

As a second improvement, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. The loop diameter of the fixing belt 21 is in a range of from about 20 mm to about 40 mm. In order to decrease the thermal capacity of the fixing belt 21 further, the fixing belt 21 may have a total thickness not greater than about 0.20 mm, preferably not greater than about 0.16 mm. Additionally, the loop diameter of the fixing belt 21 may be not greater than about 30 mm.

According to this example embodiment, the pressing roller 22 has a diameter in a range of from about 20 mm to about 40 mm so that the loop diameter of the fixing belt 21 is equivalent to the diameter of the pressing roller 22. However, the loop diameter of the fixing belt 21 and the diameter of the pressing roller 22 are not limited to the above. For example, the loop diameter of the fixing belt 21 may be smaller than the diameter of the pressing roller 22. In this case, the curvature of the fixing belt 21 at the fixing nip N is greater than that of the pressing roller 22, facilitating separation of the recording medium P discharged from the fixing nip N from the fixing belt 21.

Since the fixing belt 21 has a decreased loop diameter, space inside the loop formed by the fixing belt 21 is small. To address this circumstance, both ends of the stay 25 in the recording medium conveyance direction A1 are folded into a bracket that accommodates the halogen heater 23. Thus, the stay 25 and the halogen heater 23 are placed in the small space inside the loop formed by the fixing belt 21.

In contrast to the stay 25, the nip formation assembly 24 is compact, thus allowing the stay 25 to extend as long as possible in the small space inside the loop formed by the fixing belt 21. For example, the length of the base pad 241 of the nip formation assembly 24 is smaller than that of the stay 25 in the recording medium conveyance direction A1.

As shown in FIG. 4, the base pad 241 includes an upstream portion 24*a* disposed upstream from the fixing nip N in the recording medium conveyance direction A1; a downstream portion 24*b* disposed downstream from the fixing nip N in the recording medium conveyance direction A1; and a center portion 24*c* interposed between the upstream portion 24*a* and the downstream portion 24*b* in the recording medium conveyance direction A1. A height h1 defines a height of the upstream portion 24*a* from the fixing nip N or its hypothetical extension E in a pressurization direction D1 of the pressing roller 22 in which the pressing roller 22 is pressed against the nip formation assembly 24. A height h2 defines a height of the downstream portion 24*b* from the fixing nip N or its hypothetical extension E in the pressurization direction D1 of the pressing roller 22. A height h3, that is, a maximum height of the base pad 241, defines a height of the center portion 24*c* from the fixing nip N or its hypothetical extension E in the pressurization direction D1 of the pressing roller 22. The height h3 is not smaller than the height h1 and the height h2.

Hence, the upstream portion 24*a* of the base pad 241 of the nip formation assembly 24 is not interposed between the inner circumferential surface of the fixing belt 21 and an upstream curve 25*d*1 of the stay 25 in a diametrical direction of the fixing belt 21. Similarly, the downstream portion 24*b* of the base pad 241 of the nip formation assembly 24 is not interposed between the inner circumferential surface of the fixing belt 21 and a downstream curve 25*d*2 of the stay 25 in the diametrical direction of the fixing belt 21 and the pressurization direction D1 of the pressing roller 22. Accordingly, the upstream curve 25*d*1 and the downstream curve 25*d*2 of the stay 25 are situated in proximity to the inner circumferential surface of the fixing belt 21. Consequently, the stay 25 having an increased size that enhances the mechanical strength thereof is accommodated in the limited space inside the loop formed by the fixing belt 21. As a result, the stay 25, with its enhanced mechanical strength, supports the nip formation assembly 24 properly, preventing bending of the nip formation assembly 24 caused by pressure from the pressing roller 22 and thereby improving fixing performance.

As shown in FIG. 4, the stay 25 includes a base 25*a* contacting the nip formation assembly 24 and an upstream arm 25*b*1 and a downstream arm 25*b*2, constituting a pair of projections, projecting from the base 25*a*. The base 25*a* extends in the recording medium conveyance direction A1, that is, a vertical direction in FIG. 4. The upstream arm 25*b*1 and the downstream arm 25*b*2 project from an upstream end and a downstream end of the base 25*a*, respectively, in the recording medium conveyance direction A1 and extend in the pressurization direction D1 of the pressing roller 22 orthogonal to the recording medium conveyance direction A1. The upstream arm 25*b*1 and the downstream arm 25*b*2 projecting from the base 25*a* in the pressurization direction D1 of the pressing roller 22 elongate a cross-sectional area of the stay 25 in the pressurization direction D1 of the pressing roller 22, increasing the section modulus and the mechanical strength of the stay 25.

Additionally, as the upstream arm 25*b*1 and the downstream arm 25*b*2 elongate further in the pressurization direction D1 of the pressing roller 22, the mechanical strength of the stay 25 becomes greater. Accordingly, it is preferable that a front edge 25*c* of each of the upstream arm 25*b*1 and the downstream arm 25*b*2 is situated as close as possible to the inner circumferential surface of the fixing belt 21 to allow the upstream arm 25*b*1 and the downstream arm 25*b*2 to project longer from the base 25*a* in the pressurization direction D1 of the pressing roller 22. However, since the fixing belt 21 swings or vibrates as it rotates, if the front edge 25*c* of each of the upstream arm 25*b*1 and the downstream arm 25*b*2 is excessively close to the inner circumferential surface of the fixing belt 21, the swinging or vibrating fixing belt 21 may come into contact with the upstream arm 25*b*1 or the downstream arm 25*b*2. For example, if the thin fixing belt 21 is used as in this example embodiment, the thin fixing belt 21 swings or vibrates substantially. Accordingly, it is necessary to position the front edge 25*c* of each of the upstream arm 25*b*1 and the downstream arm 25*b*2 with respect to the fixing belt 21 carefully.

Specifically, as shown in FIG. 4, a distance d1 between the front edge 25*c* of each of the upstream arm 25*b*1 and the downstream arm 25*b*2 and the inner circumferential surface of the fixing belt 21 in the pressurization direction D1 of the pressing roller 22 is at least about 2.0 mm, preferably not smaller than about 3.0 mm. Conversely, if the fixing belt 21 is thick and therefore barely swings or vibrates, the distance d1 is about 0.02 mm. It is to be noted that if the reflector 26 is attached to the front edge 25*c* of each of the upstream arm 25*b*1 and the downstream arm 25*b*2 as in this example embodiment, the distance d1 is determined by considering the thickness of the reflector 26 so that the reflector 26 does not contact the fixing belt 21.

The front edge 25*c* of each of the upstream arm 25*b*1 and the downstream arm 25*b*2 situated as close as possible to the inner circumferential surface of the fixing belt 21 allows the upstream arm 25*b*1 and the downstream arm 25*b*2 to project longer from the base 25*a* in the pressurization direction D1 of the pressing roller 22. Accordingly, even if the fixing belt 21 has a decreased loop diameter, the stay 25 having the longer upstream arm 25*b*1 and the longer downstream arm 25*b*2 attains an enhanced mechanical strength.

With reference to FIG. 4, a description is provided of a fixing operation of the fixing device 20 described above.

As the image forming apparatus 1 depicted in FIG. 3 is powered on, the power supply supplies power to the halogen heater 23 and at the same time the driver drives and rotates the pressing roller 22 clockwise in FIG. 4 in the rotation direction R4. Accordingly, the fixing belt 21 rotates counterclockwise in FIG. 4 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the pressing roller 22 and the fixing belt 21 pressed by the pressing roller 22. The fixing belt 21 heated by the halogen heater 23 heats the recording medium P and at the same time the pressing roller 22 pressed against the fixing belt 21 and the fixing belt 21 together exert pressure to the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge 28*a* of the separator 28, the separator 28 separates the recording medium P from the fixing belt 21. Thereafter, the separated recording medium P is discharged by the output roller pair 13 depicted in FIG. 3 onto the outside of the image forming apparatus 1, that is, the output tray 14 where the recording media P are stocked.

Figure 5:
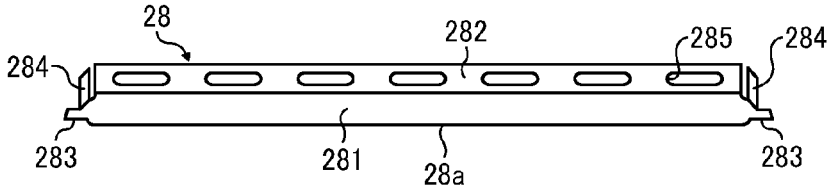
FIG. 5 is a perspective view of a separator incorporated in the fixing device shown in FIG. 4.
Figure 10:
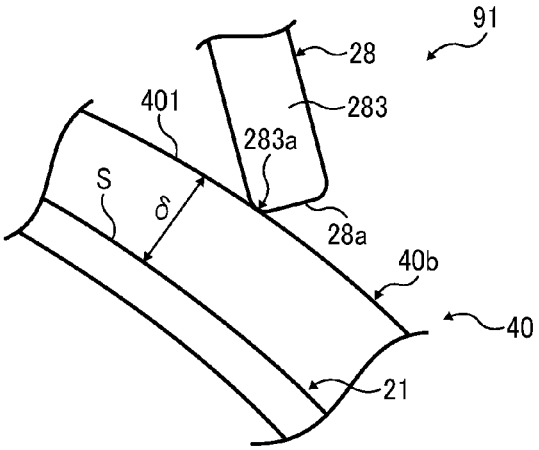
FIG. 10 is a partially enlarged vertical sectional view of a separation device incorporated in the fixing device shown in FIG. 9 illustrating the separator contacting the belt holder.

With reference to FIGS. 5 and 10, a detailed description is now given of a construction of a separation device 91 constructed of the fixing belt 21, the separator 28, and the belt holder 40 described above.

Figure 6:
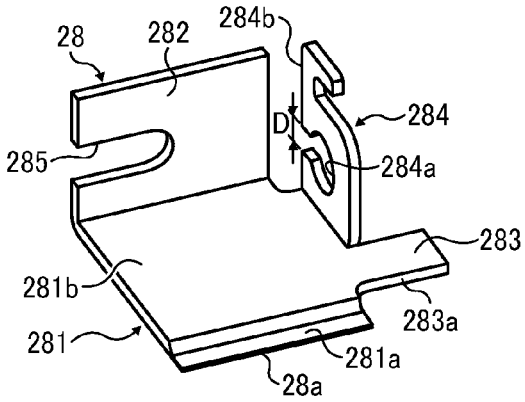
FIG. 6 is a perspective view of one lateral end of the separator shown in FIG. 5 in a longitudinal direction thereof.
Figure 7A:
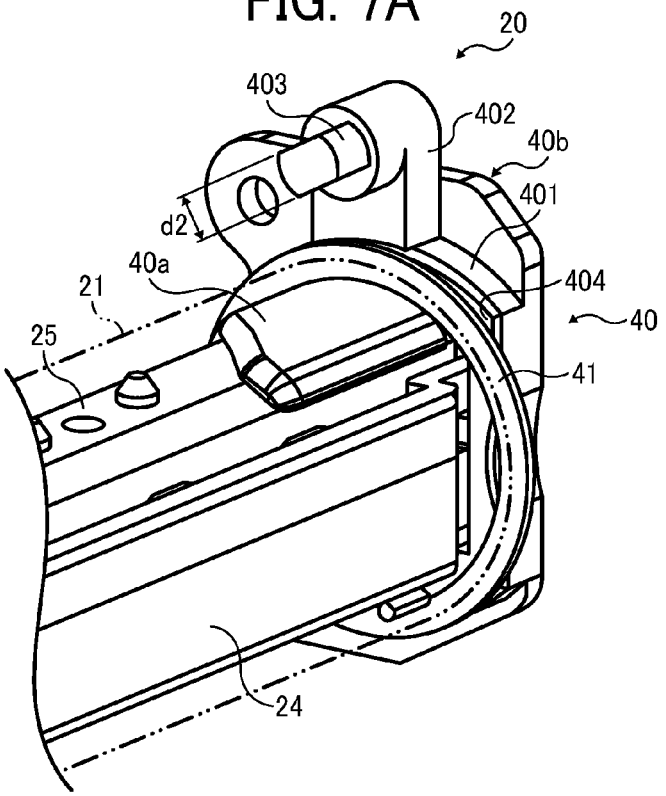
FIG. 7A is a perspective view of a belt holder incorporated in the fixing device shown in FIG. 4.
Figure 7B:
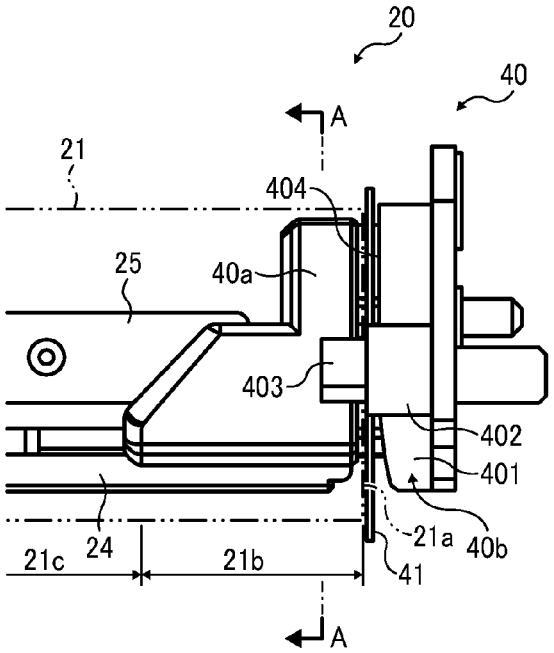
FIG. 7B is a plane view of the belt holder shown in FIG. 7A.
Figure 7C:
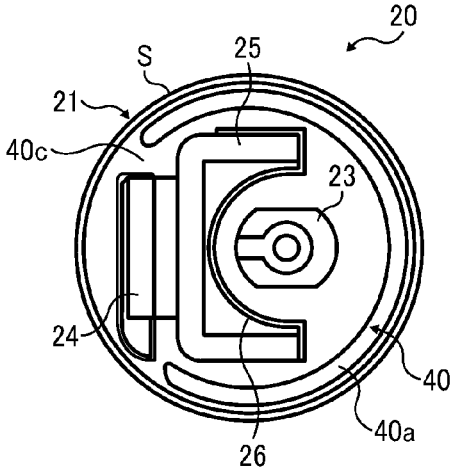
FIG. 7C is a vertical sectional view of the belt holder shown in FIG. 7B taken on the line A-A of FIG. 7B.
Figure 8:
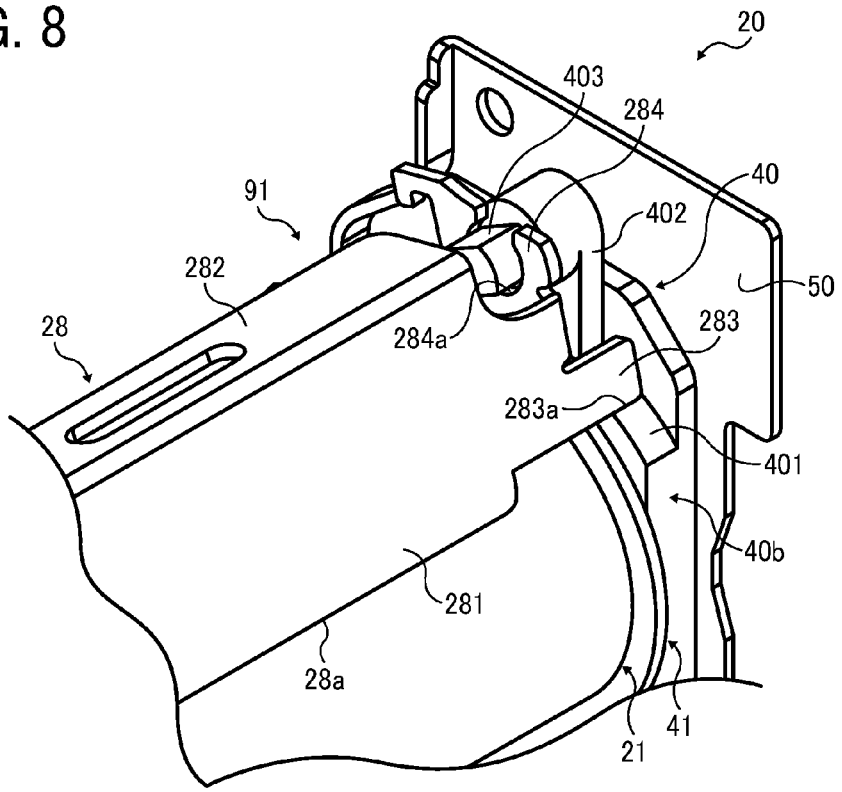
FIG. 8 is a perspective view of the fixing device shown in FIG. 4 attached with the separator shown in FIG. 5.
Figure 9:
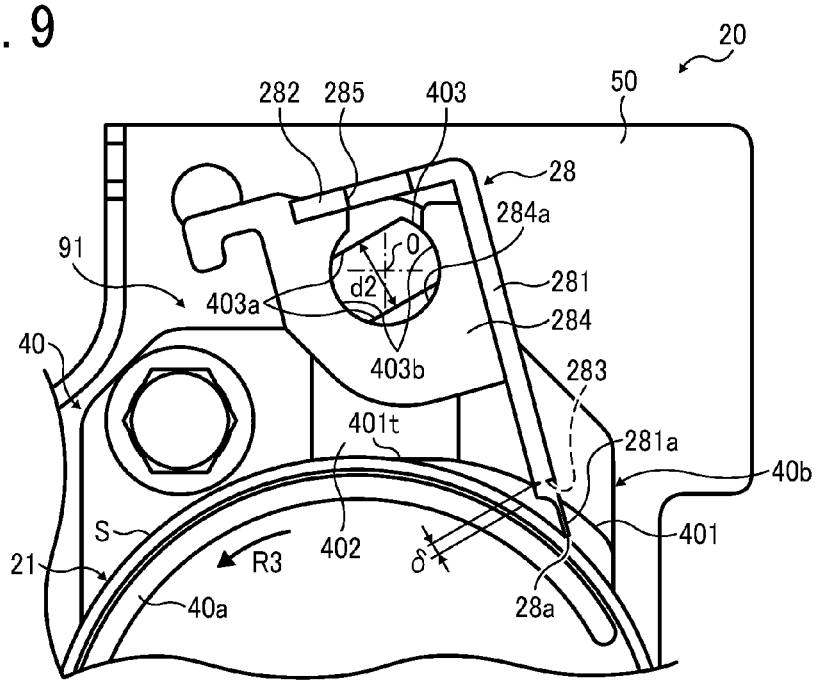
FIG. 9 is a vertical sectional view of the fixing device shown in FIG. 8.

FIG. 5 is a perspective view of the separator 28. FIG. 6 is a perspective view of one lateral end of the separator 28 in a longitudinal direction thereof. FIG. 7A is a perspective view of the belt holder 40. FIG. 7B is a plane view of the belt holder 40. FIG. 7C is a vertical sectional view of the belt holder 40 taken on the line A-A of FIG. 7B. FIG. 8 is a perspective view of the fixing device 20 attached with the separator 28. FIG. 9 is a vertical sectional view of the fixing device 20 attached with the separator 28. FIG. 10 is a partially enlarged vertical sectional view of the separation device 91 illustrating the separator 28 contacting the belt holder 40.

As shown in FIG. 5, the separator 28 is a long plate extending in the longitudinal direction thereof parallel to the axial direction of the fixing belt 21. As shown in FIG. 6, the separator 28 is constructed of a separation plate 281 and an orthogonal plate 282 extending orthogonally from one long edge of the separation plate 281. Thus, the separation plate 281 and the orthogonal plate 282 are formed into an L-shape in cross-section. The orthogonal plate 282 is produced with a plurality of through-holes 285 aligned in the longitudinal direction of the separator 28 as shown in FIG. 5. A front of the separation plate 281 disposed opposite the outer circumferential surface S of the fixing belt 21 is formed into a thin front 281*a* having a reduced thickness throughout the entire width in the longitudinal direction of the separator 28.

As shown in FIG. 5, a contact plate 283 and a bracket 284 are produced at both lateral ends of the separator 28 in the longitudinal direction thereof. As shown in FIG. 6, the contact plate 283 projects and extends from each lateral edge of the separation plate 281 in the longitudinal direction of the separator 28. For example, the separation plate 281 is constructed of a body 281*b* and the thin front 281*a* thinner than the body 281*b* and projecting from a long edge of the body 281*b*. The contact plate 283 is contiguous to and projects from each lateral edge of the body 281*b* in the longitudinal direction of the separator 28. The thickness of the contact plate 283 is equivalent to that of the body 281*b*. Thus, a front face of the contact plate 283 is contiguous to a front face of the body 281*b*, producing an identical plane. Similarly, a back face of the contact plate 283 is contiguous to a back face of the body 281*b*, producing an identical plane.

The bracket 284 projects orthogonally from the lateral edge of the body 281*b* in a direction orthogonal to the longitudinal direction of the separator 28. A notch 284*a* is produced at a back edge 284*b* of the bracket 284 facing the orthogonal plate 282 and extending along a projection direction of the orthogonal plate 282 projecting from the separation plate 281. The notch 284*a* is constructed of a circular head and a neck contiguous to the head and the back edge 284*b* of the bracket 284. The neck has a width D in the projection direction of the orthogonal plate 282 which is smaller than that of the head. It is to be noted that FIG. 5 schematically illustrates the bracket 284 and therefore does not illustrate the notch 284*a*.

The separation plate 281, the orthogonal plate 282, the contact plate 283, and the bracket 284 are integrally manufactured into the separator 28. For example, a metal plate is pressed into the separator 28. The thin front 281*a* of the separation plate 281 is manufactured separately before or after the metal plate is pressed into the separator 28. Alternatively, the thin front 281*a* may be manufactured simultaneously when the metal plate is pressed into the separator 28. Since the contact plate 283 and the body 281*b* of the separation plate 281 share an identical plane, it is not necessary to bend the contact plate 283. Accordingly, the contact plate 283 is positioned with respect to the separation plate 281 precisely, minimizing variation in precision of the contact plate 283. The separator 28 is manufactured by plastic working of metal as described above or by injection molding of resin.

With reference to FIGS. 7A to 7C, a detailed description is now given of a construction of the belt holder 40.

FIGS. 7A to 7C illustrate the belt holder 40 situated at one lateral end of the fixing belt 21 in the axial direction thereof. Although not shown, another belt holder 40 situated at another lateral end of the fixing belt 21 in the axial direction thereof has the identical configuration shown in FIGS. 7A to 7C. Hence, the following describes the configuration of the belt holder 40 situated at one lateral end of the fixing belt 21 in the axial direction thereof with reference to FIGS. 7A to 7C.

As shown in FIGS. 7A and 7B, the belt holder 40 is constructed of a tube 40*a* having substantially a tubular outer circumferential surface and a flange 40*b* disposed outboard from the tube 40*a* in the axial direction of the fixing belt 21 and projecting beyond the tube 40*a* radially. For example, the belt holder 40 is made of injection molded resin constituting the tube 40*a* and the flange 40*b*. As shown in FIG. 7C, the tube 40*a* of the belt holder 40 is inverted C-shaped in cross-section to create an opening 40*c* disposed opposite the fixing nip N where the nip formation assembly 24 is situated. As shown in FIG. 7B, the tube 40*a* is loosely fitted into the loop formed by the fixing belt 21 to rotatably support and guide each lateral end 21*b* of the fixing belt 21 in the axial direction thereof. Conversely, a center 21*c* of the fixing belt 21 in the axial direction thereof not supported by the tube 40*a* contacts the nip formation assembly 24 only and therefore is flexibly deformable. As shown in FIG. 7B, each lateral end of the stay 25 in a longitudinal direction thereof parallel to the axial direction of the fixing belt 21 is mounted on the belt holder 40.

Additionally, since the fixing belt 21 is shaped linearly by the nip formation assembly 24 at the fixing nip N as shown in FIG. 4, the fixing belt 21 is constantly exerted with a force that deforms the fixing belt 21 into an ellipse in cross-section in a direction of the normal to the fixing nip N as a short direction. Accordingly, an increased strain is exerted on the fixing belt 21 and the fixing belt 21 is deformed repeatedly in accordance with change in the curvature of the fixing belt 21 as it rotates. Consequently, unless measure is taken against this circumstance, the lateral end 21*b* of the fixing belt 21 in the axial direction thereof may be damaged, which eventually produces cracks throughout the fixing belt 21, degrading durability of the fixing belt 21 substantially. To address this problem, the tube 40*a* supports each lateral end 21*b* of the fixing belt 21 in the axial direction thereof, retaining a substantially circular shape of the fixing belt 21 in cross-section at each lateral end 21*b* of the fixing belt 21.

As shown in FIG. 7A, an upper inboard part of the flange 40*b* is eliminated to create a positioning portion 401 drawing a convex curve in a circumferential direction of the fixing belt 21. The positioning portion 401 projects beyond the outer circumferential surface S of the fixing belt 21 radially. As shown in FIG. 9, a step height δ is provided between the positioning portion 401 and the outer circumferential surface S of the fixing belt 21. The step height δ gradually changes in the rotation direction R3 of the fixing belt 21. For example, the step height δ is zero at a top 401*t* of the positioning portion 401 and gradually increases as the position on the positioning portion 401 moves lower rightward in FIG. 9 in a direction counter to the rotation direction R3 of the fixing belt 21. A projection 402 is situated at one edge of the positioning portion 401 in the circumferential direction of the fixing belt 21 that is above another edge of the positioning portion 401 in the circumferential direction of the fixing belt 21. The projection 402 projects from the positioning portion 401 upward in FIG. 7A.

As shown in FIG. 7A, an axis pin 403 is mounted on the projection 402 and projects inboard from the projection 402 in the axial direction of the fixing belt 21. As shown in FIG. 9, the axis pin 403 is substantially rectangular with two opposed linear sides 403*a* and two opposed curved sides 403*b*. For example, a cylinder is partially cut away to produce the two opposed linear sides 403*a* of the axis pin 403. A distance d2 between the two opposed linear sides 403*a* in a diametrical direction of the axis pin 403 is smaller than the width D depicted in FIG. 6 of the neck of the notch 284*a* produced through the bracket 284 of the separator 28. Each lateral end of the separator 28 in the longitudinal direction thereof is supported by the belt holder 40, thus being installed in the fixing device 20.

With reference to FIG. 9, a detailed description is now given of attachment of the separator 28 to the belt holder 40.

As shown in FIG. 9, the axis pin 403 of the belt holder 40 is inserted into the neck of the notch 284*a* produced through the bracket 284 of the separator 28 in a state in which the two opposed linear sides 403*a* of the axis pin 403 are parallel to two opposed interior walls of the neck of the notch 284*a*. Thereafter, the separator 28 is rotated until the contact plate 283 of the separator 28 comes into contact with the positioning portion 401 of the belt holder 40. Thus, the separator 28 is attached to the belt holder 40. Accordingly, the separator 28 is supported by the belt holder 40 in such a manner that the separator 28 is rotatable about an axis O of the axis pin 403. The two opposed curved sides 403*b* of the axis pin 403 of the belt holder 40 engage the head of the notch 284*a* produced through the bracket 284 of the separator 28, preventing the separator 28 from being detached from the belt holder 40. Additionally, as the contact plate 283 of the separator 28 contacts the positioning portion 401 of the belt holder 40, the separator 28 is positioned with respect to the fixing belt 21. Hence, a given separation interval g depicted in FIG. 4 is created between the front edge 28*a* of the separation plate 281 of the separator 28 and the outer circumferential surface S of the fixing belt 21.

As shown in FIG. 7B, a slip ring 41 is interposed between a lateral edge 21*a* of the fixing belt 21 and an inward face 404 of the flange 40*b* of the belt holder 40 disposed opposite the lateral edge 21*a* of the fixing belt 21 in the axial direction thereof. The slip ring 41 serves as a protector that protects the lateral end 21*b* of the fixing belt 21 in the axial direction thereof. For example, even if the fixing belt 21 is skewed in the axial direction thereof, the slip ring 41 prevents the lateral edge 21*a* of the fixing belt 21 from coming into direct contact with the belt holder 40, thus minimizing abrasion and breakage of the lateral edge 21*a* of the fixing belt 21 in the axial direction thereof. Since an inner diameter of the slip ring 41 is sufficiently greater than an outer diameter of the tube 40*a* of the belt holder 40, the slip ring 41 loosely slips on the tube 40*a*. Hence, if the lateral edge 21*a* of the fixing belt 21 contacts the slip ring 41, the slip ring 41 is rotatable in accordance with rotation of the fixing belt 21. Alternatively, the slip ring 41 may remain at rest instead of rotating in accordance with rotation of the fixing belt 21. The slip ring 41 is made of heat-resistant resin such as PEEK, PPS, PAI, and PTFE.

According to this example embodiment, the single slip ring 41 is used. Alternatively, two or more slip rings 41 may be interposed between the fixing belt 21 and the belt holder 40.

As shown in FIG. 8, after the separator 28 is attached to the belt holder 40 as described above, a side plate 50 is attached to the belt holder 40 provided at each lateral end 21*b* of the fixing belt 21 in the axial direction thereof. Thus, the belt holder 40 mounted on the side plate 50 is positioned in the image forming apparatus 1 shown in FIG. 3.

As described above, the separator 28 is positioned by the stationary, rigid belt holder 40, not by the rotatable, flexible fixing belt 21 flexibly deformable at the center 21*c* thereof depicted in FIG. 7B. That is, the separator 28 is positioned not by the deformable outer circumferential surface S of the fixing belt 21 but by the rigid belt holder 40. Thus, the separator 28 is positioned with respect to the fixing nip N with improved accuracy. Accordingly, the separation interval g depicted in FIG. 4 is defined precisely, preventing jamming of the recording medium P caused by separation failure, damage to the fixing belt 21 that may occur as the fixing belt 21 contacts the separator 28, and formation of a faulty toner image caused by damage to the fixing belt 21.

As shown in FIG. 6, the contact plate 283 is not bent so that the contact plate 283 and the separation plate 281 produce the identical plane. Accordingly, the contact plate 283 is manufactured with minimized variation in work precision that allows the separator 28 to be positioned with respect to the outer circumferential surface S of the fixing belt 21 with improved precision.

As shown in FIG. 9, the positioning portion 401 of the belt holder 40 projects beyond the outer circumferential surface S of the fixing belt 21 radially. Accordingly, the contact plate 283 projecting from the separation plate 281 in the longitudinal direction of the separator 28 contacts the positioning portion 401 of the belt holder 40. Hence, the separator 28 is simplified.

As shown in FIG. 8, as a lower corner 283*a* of the contact plate 283 of the separator 28 contacts the positioning portion 401 of the belt holder 40, the separator 28 is positioned with respect to the fixing belt 21. For example, the contact plate 283 of the separator 28 linearly contacts the positioning portion 401 of the belt holder 40 in the axial direction of the fixing belt 21. Accordingly, compared to a configuration in which the contact plate 283 of the separator 28 contacts the positioning portion 401 of the belt holder 40 at surface thereof in a substantial area, even if the resin belt holder 40 is deformed by thermal expansion, for example, the separator 28 is positioned with respect to the fixing belt 21 more precisely.

As shown in FIG. 10, the lower corner 283*a* of the contact plate 283 of the separator 28 that contacts the positioning portion 401 of the belt holder 40 is curved. Accordingly, even if the lower corner 283*a* of the contact plate 283 strikes the positioning portion 401 of the belt holder 40 with a substantial impact due to impact load, the curved lower corner 283*a* of the contact plate 283 does not deform itself and the positioning portion 401 of the belt holder 40. If the contact plate 283 is a thin plate, a front edge face of the contact plate 283 disposed opposite the positioning portion 401 may be curved entirely. Considering work precision and the advantages described above of the contact plate 283, it is preferable that the lower corner 283*a* of the contact plate 283 has a roundness not smaller than about 0.1 mm.

Figure 11:
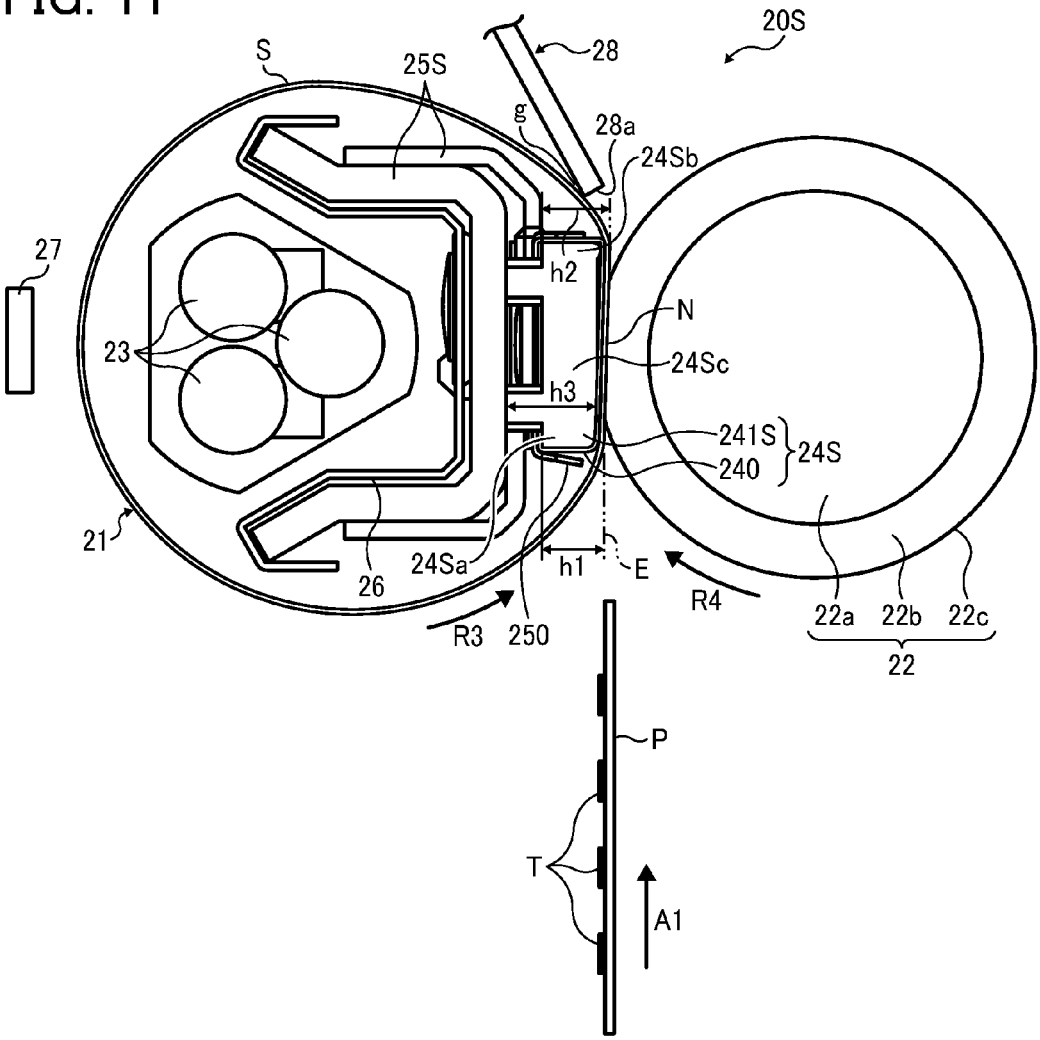
FIG. 11 is a vertical sectional view of a fixing device according to a second example embodiment of the present invention.

With reference to FIG. 11, a description is provided of a configuration of a fixing device 20S according to a second example embodiment.

FIG. 11 is a vertical sectional view of the fixing device 20S. Unlike the fixing device 20 depicted in FIG. 4, the fixing device 20S includes three halogen heaters 23 serving as heaters that heat the fixing belt 21. The three halogen heaters 23 have three different regions thereof in the axial direction of the fixing belt 21 that generate heat. Accordingly, the three halogen heaters 23 heat the fixing belt 21 in three different regions on the fixing belt 21, respectively, in the axial direction thereof so that the fixing belt 21 heats recording media P of various widths in the axial direction of the fixing belt 21.

The fixing device 20S further includes a metal plate 250 that partially surrounds a nip formation assembly 24S. Thus, a substantially W-shaped stay 25S accommodating the three halogen heaters 23 supports the nip formation assembly 24S via the metal plate 250.

Instead of the bracket-shaped stay 25 shown in FIG. 4, the fixing device 20S includes the substantially W-shaped stay 25S that houses the three halogen heaters 23. Instead of the substantially rectangular nip formation assembly 24 shown in FIG. 4, the fixing device 20S includes the nip formation assembly 24S having a recess at a center thereof in the recording medium conveyance direction A1. Similar to the heights h1, h2, and h3 shown in FIG. 4, the heights h1, h2, and h3 shown in FIG. 11 define the height of an upstream portion 24Sa of a base pad 241S, the height of a downstream portion 24Sb of the base pad 241S, and the height of a center portion 24Sc of the base pad 241S, respectively. In order to increase the size of the stay 25S disposed in the limited space inside the loop formed by the fixing belt 21, the height h3 is not smaller than the height h1 and the height h2.

The fixing device 20S includes the separator 28 and the belt holder 40 described above with reference to FIGS. 5 to 10, attaining the advantages described above.

With reference to FIGS. 4 to 11, a description is provided of advantages of the separator 28 and the fixing devices 20 and 20S incorporating the separator 28 described above.

As shown in FIGS. 4 and 7B, the separator 28 includes the front edge 28*a* isolated from the endless fixing belt 21 supported by the belt holder 40 contacting each lateral end 21*b* of the fixing belt 21 in the axial direction thereof. The fixing belt 21 contacts the pressing roller 22 to form the fixing nip N therebetween. As a recording medium P bearing a toner image T is discharged from the fixing nip N, the front edge 28*a* of the separator 28 contacts the recording medium P, separating the recording medium P from the outer circumferential surface S of the fixing belt 21. As shown in FIG. 9, the separator 28 is positioned with respect to the outer circumferential surface S of the fixing belt 21 by the stationary, rigid belt holder 40 as the contact plate 283 of the separator 28 contacts the positioning portion 401 of the belt holder 40. Accordingly, compared to a configuration in which the separator 28 is positioned with respect to the fixing belt 21 by the deformable, flexible fixing belt 21, the separator 28 is positioned with improved precision. Consequently, as shown in FIGS. 4 and 11, the separation interval g is produced between the separator 28 and the outer circumferential surface S of the fixing belt 21 with improved precision, preventing jamming of the recording medium P caused by separation failure, damage to the fixing belt 21 that may occur as the separator 28 contacts the fixing belt 21, and formation of a faulty toner image caused by damage to the fixing belt 21.

As shown in FIG. 6, the contact plate 283 contacting the belt holder 40 shares the identical plane with the separation plate 281 having the front edge 28*a*. That is, the contact plate 283 is integrally molded with the separation plate 281, eliminating assembly error that may arise if the contact plate 283 is separately provided from the separation plate 281. Accordingly, the contact plate 283 of the separator 28 is positioned with respect to the positioning portion 401 of the belt holder 40 precisely, thus improving accuracy in positioning the separator 28 with respect to the fixing belt 21.

As shown in FIG. 6, the contact plate 283 and the separation plate 281 having the front edge 28*a* share the identical plane, reducing work error of the contact plate 283 and thereby improving accuracy in positioning the separator 28 with respect to the fixing belt 21. For example, a state in which the contact plate 283 and the separation plate 281 share the identical plane defines a state in which the contact plate 283 is not bent with respect to the separation plate 281 having the front edge 28*a*. It is defined in the example embodiments described above that if there is no bending line between the contact plate 283 and the separation plate 281 and at the same time the contact plate 283 extends from the separation plate 281, even if there is a step between a surface of the separation plate 281 and a surface of the contact plate 283, the contact plate 283 and the separation plate 281 share the identical plane.

As shown in FIG. 10, the curved corner 283*a* of the contact plate 283 that contacts the positioning portion 401 of the belt holder 40 has a roundness that prevents deformation of the contact plate 283 and the belt holder 40 even if the contact plate 283 strikes the positioning portion 401 of the belt holder 40 with a substantial impact.

As shown in FIGS. 4 and 11, the fixing devices 20 and 20S include the separator 28 described above, the fixing belt 21 serving as an endless belt; the belt holder 40; the halogen heater 23 that heats the fixing belt 21; the nip formation assembly (e.g., the nip formation assemblies 24 and 24S) situated inside the loop formed by the fixing belt 21; and the pressing roller 22 serving as an opposed rotary body pressed against the nip formation assembly via the fixing belt 21 to form the fixing nip N between the pressing roller 22 and the fixing belt 21. The separator 28 supported by the belt holder 40 defines the separation interval g between the front edge 28*a* of the separator 28 and the outer circumferential surface S of the fixing belt 21 precisely.

As shown in FIG. 7B, the belt holder 40 includes the tube 40*a* disposed opposite the inner circumferential surface of the fixing belt 21 and the flange 40*b* disposed outboard from the tube 40*a* in the axial direction of the fixing belt 21 and projecting beyond the tube 40*a* radially. The flange 40*b* mounts the positioning portion 401 that contacts the contact plate 283 of the separator 28 as shown in FIG. 8.

As shown in FIG. 9, the positioning portion 401 mounted on the flange 40*b* of the belt holder 40 and in contact with the contact plate 283 of the separator 28 projects beyond the outer circumferential surface S of the fixing belt 21 radially. Accordingly, as shown in FIG. 8, the contact plate 283 projects outboard from the separation plate 281 having the front edge 28*a* in the axial direction of the fixing belt 21, resulting in simplification of the separator 28.

As shown in FIG. 7B, the slip ring 41 is interposed between the tube 40*a* and the flange 40*b* in the axial direction of the fixing belt 21. Accordingly, even if the fixing belt 21 is skewed in the axial direction thereof, the slip ring 41 prohibits the lateral edge 21*a* of the fixing belt 21 from coming into contact with the flange 40*b* of the belt holder 40, preventing abrasion and breakage of the lateral end 21*b* of the fixing belt 21.

As shown in FIGS. 4 and 11, the separator 28 includes the front edge 28*a* isolated from the endless fixing belt 21 supported by the belt holder 40 (depicted in FIG. 7B) disposed at each lateral end 21*b* of the fixing belt 21 in the axial direction thereof. The fixing belt 21 contacts the pressing roller 22 to form the fixing nip N therebetween. As a recording medium P is discharged from the fixing nip N, the front edge 28*a* of the separator 28 contacts and separates the recording medium P from the outer circumferential surface S of the fixing belt 21. The belt holder 40 positions the separator 28 with respect to the outer circumferential surface S of the fixing belt 21.

The separator 28 is positioned with respect to the outer circumferential surface S of the fixing belt 21 by the belt holder 40, not by the fixing belt 21. Accordingly, even if the flexible fixing belt 21 is deformed, the separator 28 is positioned with respect to the fixing belt 21 precisely. Consequently, variation in the separation interval g between the front edge 28*a* of the separator 28 and the outer circumferential surface S of the fixing belt 21 is minimized. That is, the uniform separation interval g is provided substantially throughout the entire width in the axial direction of the fixing belt 21, achieving stable separation of the recording medium P from the fixing belt 21 by the separator 28 and thereby preventing jamming of the recording medium P. Since the belt holder 40 retains the separator 28 isolated from the fixing belt 21, the separator 28 does not damage the fixing belt 21, preventing formation of a faulty toner image on the recording medium P.

The example embodiments described above are applied to the fixing devices 20 and 20S incorporating the thin fixing belt 21 having a reduced loop diameter to save more energy. Alternatively, the example embodiments described above are applicable to other fixing devices. Additionally, as shown in FIG. 3, the image forming apparatus 1 incorporating the fixing device 20 or 20S is a color laser printer. Alternatively, the image forming apparatus 1 may be a monochrome printer, a copier, a facsimile machine, a multifunction printer (MFP) having at least one of copying, printing, facsimile, and scanning functions, or the like.

According to the example embodiments described above, the pressing roller 22 serves as an opposed rotary body disposed opposite the fixing belt 21. Alternatively, a pressing belt or the like may serve as an opposed rotary body. Further, the halogen heater 23 disposed inside the fixing belt 21 serves as a heater that heats the fixing belt 21. Alternatively, the halogen heater 23 may be disposed outside the fixing belt 21.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A separator for separating a recording medium from an outer circumferential surface of an endless belt supported by a belt holder contacting each lateral end of the endless belt in an axial direction thereof, the separator comprising:

a front edge disposed opposite the outer circumferential surface of the endless belt, the front edge to contact and separate the recording medium from the endless belt;

a separation plate mounting the front edge;

a contact plate projecting from the separation plate in the axial direction of the endless belt and contacting the belt holder; and a bracket projecting from the separation plate in a direction orthogonal to the direction in which the contact plate projects from the separation plate, the bracket including a notch that engages the belt holder, wherein the contact plate contacting the belt holder and the notch of the bracket engaging the Mt holder produce an interval between the front edge of the separator and the outer circumferential surface of the endless belt.

2. The separator according to claim 1, wherein the contact plate is integrally molded with the separation plate to share an identical plane with the separation plate.

3. The separator according to claim 1, wherein the contact plate includes a curved corner contacting the belt holder.

4. A separation device comprising:

an endless belt rotatable in a given direction of rotation;

a belt holder contacting and supporting each lateral end of the endless belt in an axial direction thereof; and a separator disposed opposite an outer circumferential surface of the endless belt and including a front edge to contact and separate the recording medium from the endless belt, the separator contacted and positioned by the belt holder with respect to the outer circumferential surface of the endless belt with an interval between the front edge of the separator and the outer circumferential surface of the endless belt.

5. The separation device according to claim 4, wherein the separator further includes:

a separation plate mounting the front edge; and a contact plate projecting from the separation plate in the axial direction of the endless belt and contacting the belt holder, the contact plate integrally molded with the separation plate.

6. The separation device according to claim 5, wherein the separation plate and the contact plate share an identical plane.

7. The separation device according to claim 5, wherein the contact plate includes a curved corner contacting the belt holder.

8. A fixing device comprising:

an endless belt rotatable in a given direction of rotation;

a belt holder contacting and supporting each lateral end of the endless belt in an axial direction thereof;

a nip formation assembly disposed opposite an inner circumferential surface of the endless belt;

an opposed rotary body pressed against the nip formation assembly via the endless belt to form a fixing nip between the opposed rotary body and the endless belt through which a recording medium is conveyed; and a separator disposed opposite an outer circumferential surface of the endless belt and including a front edge to contact and separate the recording medium from the endless belt, the separator contacted and positioned by the belt holder with respect to the outer circumferential surface of the endless belt with an interval between the front edge of the separator and the outer circumferential surface of the endless belt.

9. The fixing device according to claim 8, wherein the separator further includes:

a separation plate mounting the front edge; and a contact plate projecting from the separation plate in the axial direction of the endless belt and contacting the belt holder, the contact plate integrally molded with the separation plate.

10. The fixing device according to claim 9, wherein the separation plate of the separator includes:

a body contiguous to the contact plate at a first edge of the body; and a thin front thinner than the body and projecting from a second edge of the body orthogonal to the first edge, the thin front having the front edge that contacts the recording medium.

11. The fixing device according to claim 9, wherein the belt holder includes:

a tube disposed opposite the inner circumferential surface of the endless belt; and a flange disposed outboard from the tube in the axial direction of the endless belt and including a positioning portion projecting beyond the tube radially and contacting the contact plate of the separator.

12. The fixing device according to claim 11, wherein the positioning portion of the flange of the belt holder projects beyond the outer circumferential surface of the endless belt radially.

13. The fixing device according to claim 11, wherein a step height is provided between the positioning portion of the flange of the belt holder and the outer circumferential surface of the endless belt.

14. The fixing device according to claim 13, wherein the step height gradually changes in the direction of rotation of the endless belt.

15. The fixing device according to claim 11, wherein the separator further includes a bracket projecting from the separation plate in a direction orthogonal to the direction in which the contact plate projects from the separation plate, the bracket including a notch.

16. The fixing device according to claim 15, wherein the flange of the belt holder further includes a projection projecting from the positioning portion in a diametrical direction of the tube and mounting an axis pin projecting inboard from the projection in the axial direction of the endless belt, and wherein the axis pin of the belt holder engages the notch of the separator.

17. The fixing device according to claim 16, wherein the separator is rotatable about the axis pin of the belt holder.

18. The fixing device according to claim 11, further comprising a slip ring interposed between the tube and the flange of the belt holder in the axial direction of the endless belt, the slip ring separatably contactable to a lateral edge of the endless belt in the axial direction thereof.

19. The fixing device according to claim 8, further comprising a heater disposed opposite the inner circumferential surface of the endless belt to heat the endless belt.

20. An image forming apparatus comprising the fixing device according to claim 8.

* * * * *